US007843182B2

(12) United States Patent
Ii

(10) Patent No.: US 7,843,182 B2
(45) Date of Patent: Nov. 30, 2010

(54) UNIT OPERABLE IN A PLURALITY OF OPERATING MODES, DEVICE, AND TRANSMITTING/RECEIVING SYSTEM

(75) Inventor: Naoki Ii, Suwa (JP)

(73) Assignee: Seiko Epson Corporation (JP)

( * ) Notice: Subject to any disclaimer, the term of this patent is extended or adjusted under 35 U.S.C. 154(b) by 410 days.

(21) Appl. No.: 11/906,125

(22) Filed: Sep. 28, 2007

(65) Prior Publication Data

US 2008/0079414 A1 Apr. 3, 2008

(30) Foreign Application Priority Data

Oct. 2, 2006 (JP) ..... 2006-270942
Sep. 11, 2007 (JP) ..... 2007-235610

(51) Int. Cl.
*G05F 1/40* (2006.01)

(52) U.S. Cl. ..... 323/282

(58) Field of Classification Search ..... 323/268, 323/271, 282, 283, 285, 349–351
See application file for complete search history.

(56) References Cited

U.S. PATENT DOCUMENTS 6,307,762 B1 10/2001 Shiobara
6,348,744 B1 * 2/2002 Levesque ..... 307/86
6,912,411 B1 * 6/2005 Seki ..... 455/572
7,183,856 B2 * 2/2007 Miki et al. ..... 330/297
2003/0011247 A1 1/2003 Kajiwara et al.

FOREIGN PATENT DOCUMENTS

JP 2000-184719 6/2000
JP 2002-91579 3/2002
JP 2002-190995 7/2002
JP 2003-143836 5/2003

* cited by examiner

*Primary Examiner*—Matthew V Nguyen
(74) *Attorney, Agent, or Firm*—Harness, Dickey & Pierce, P.L.C.

(57) ABSTRACT

A unit operable in a plurality of operating modes includes a first circuit, a regulator and current controller. The first circuit is adapted to operate in a first operating mode, and not to operate in a second operating mode preceding the first operating mode. The a regulator is adapted to supply driving voltage to the first circuit, and switchable among a plurality of levels of internal current. The current controller adapted to control the internal current of the regulator in the first operating mode to a first level among the plurality of levels of internal current. The current controller adapted control the internal current of the regulator in the second operating mode to a second level among the plurality of levels of internal current. The second level is lower than the first level.

10 Claims, 13 Drawing Sheets

DATA TRANSMITTING CIRCUIT
LP1
LN1
VLS
VSS
VLS
VSS
SINGLE END TRANSMISSION MODE
HIGH IMPEDANCE STATE
SINGLE END RECEPTION MODE
HIGH IMPEDANCE STATE
REVERSAL REQUEST

DATA RECEIVING CIRCUIT
LP1
LN1
VLS
VSS
VLS
VSS
HIGH IMPEDANCE STATE
SINGLE END RECEPTION MODE
HIGH IMPEDANCE STATE
SINGLE END TRANSMISSION MODE

EN1
EN2
H
L
H
L
T1

UNIT OPERABLE IN A PLURALITY OF OPERATING MODES, DEVICE, AND TRANSMITTING/RECEIVING SYSTEM

CROSS REFERENCE TO RELATED APPLICATIONS

This application relates to and claims priority from Japanese Patent Applications No. 2006-270942, filed on Oct. 2, 2006 and No. 2007-235610, filed on Sep. 11, 2007, the entire disclosure of which is incorporated by reference.

BACKGROUND

1. Technical Field

The present invention relates to a unit including a circuit; to a device; to a transmitting/receiving system, especially to a unit that is operable in a plurality of operating modes; to a device; and to a transmitting/receiving system.

2. Description of the Related Art

In instances where the driving voltage of an electronic circuit differs from the power supply voltage supplied to it, the power supply voltage is stepped up or stepped down using a regulator. It is common practice to provide a bypass capacitor in order to stabilize operation of the regulator and the circuits for supplying the driving voltage from the regulator. In such an electronic circuit, stable operation is afforded with the bypass capacitor in the charged state.

One known voltage regulator intended to quickly stabilize operation is one designed with a differential pulse generating circuit, so that a current limiter circuit for the transistor which outputs the current will not operate at startup.

However, a drawback of the voltage regulator described above is, for example, that since the bypass capacitor is charged by excessively high current flowing from the power supply, noise will be generated during charging, with possible adverse effects on nearby circuits.

SUMMARY

An advantage of some aspects of the invention is, for example, to provide an electronic circuit for supplying driving voltage using a regulator, the circuit affording rapid stabilization of operation.

A first aspect of the present invention provides a unit operable in a plurality of operating modes. The unit pertaining to the first aspect comprises a first circuit, a regulator and a current controller. The first circuit is adapted to operate in a first operating mode, and not to operate in a second operating mode preceding the first operating mode. The regulator adapted to supply driving voltage to the first circuit, and switchable among a plurality of levels of internal current. The current controller adapted to control the internal current of the regulator in the first operating mode to a first level among the plurality of levels of internal current. The current controller adapted to control the internal current of the regulator in the second operating mode to a second level among the plurality of levels of internal current. The second level is lower than the first level.

According to the unit pertaining to the first aspect, in a second operating mode which precedes a first operating mode, the regulator operates at relatively low internal current. Thus, for example, during startup in the first operating mode excessively high current flow can be suppressed, while operation of the regulator and the first circuit can be stabilized quickly. Therefore, for example, operation of the regulator and the first circuit can be stabilized quickly, while suppressing noise.

In the unit pertaining to the first aspect, the unit may include a transmitting/receiving unit including a receiving circuit adapted to receive a signal from another unit and a transmitting circuit adapted to transmitting a signal to another unit. The first circuit may include the transmitting circuit. The first operating mode may include a mode for transmitting a signal using the transmitting circuit. The second operating mode may include a mode for receiving a signal using the receiving circuit. In this case, operation of the transmission circuit in the transmitting/receiving unit can be stabilized quickly while suppressing noise, for example.

In the unit pertaining to the first aspect, when the receiving circuit has received a reply request signal in the second operating mode, the unit may transit from the second operating mode to the first operating mode and the current controller may switch the internal current of the regulator from the second level to the first level. In this case, operation of the transmission circuit during transition from the second mode to the first mode may be stabilized quickly while suppressing noise, for example.

A second aspect of the invention provides a unit operable in a plurality of operating modes. The unit pertaining to the second aspect comprises a first circuit, a capacitor and a regulator. The capacitor is for stabilizing operation of the first circuit. The regulator is adapted to charge the capacitor using a first level of electric current prior to operation of the first circuit. The regulator is adapted to charge the capacitor using a second level of electric current higher than the first level during operation of the first circuit.

According to the unit pertaining to the second aspect, prior to operation of the first circuit, the regulator uses a first level of electrical current to charge the capacitor, thereby, for example, obviating the need for excessively high current flow to charge the capacitor at the time of startup of the first operating mode. As a result, for example, noise may be suppressed, and operation of the regulator and the first circuit may be stabilized quickly.

In the unit pertaining to the second aspect, the first circuit may operate using an output voltage of the regulator as a power supply voltage. The capacitor may include a bypass capacitor for stabilizing the output voltage of the regulator.

In the unit pertaining to the second aspect, the unit may include a transmitting/receiving unit including a receiving circuit adapted to receive a signal from another unit and a transmitting circuit adapted to transmitting a signal to another unit. The first circuit may include the transmitting circuit. In this case, operation of the transmission circuit may be stabilized quickly while suppressing noise, for example.

In the unit pertaining to the second aspect, the unit may be operable in a transmitting mode for transmitting a signal using the transmitting circuit, and a receiving mode for receiving a signal using the receiving circuit. The regulator may be adapted to charge the capacitor using the first level of electric current in the receiving mode and charge the capacitor using the second level of electric current in the transmitting mode. In some cases, when the receiving circuit has received a reply request signal in the receiving mode, the unit may transit from the receiving mode to the transmitting mode and the regulator may switch the electric current used to charge the capacitor from the first level of electric current to the second level of electric current. In this case, operation of the transmitting circuit during transition from receiving mode to transmitting mode may be stabilized quickly while suppressing noise, for example.

The present invention can be realized in various aspects, for example, a device comprising the unit of the above-mentioned aspects and a display driver adapted to drive a display device using the signal received by the unit. The invention can also be realized as a device comprising the unit of the above-mentioned aspects and a driver adapted to drive a electro optical device using the signal received by the unit. Furthermore, the invention can be realized as a transmitting/receiving system including a first transmitting/receiving unit and a second transmitting/receiving unit interconnected via signal lines, wherein at least one of the first transmitting/receiving unit and the second transmitting/receiving unit includes the unit of the above-mentioned aspects. Furthermore, the invention is not to be considered limited to the apparatus-invention, may be realized as a method-invention. For example, the invention can be realized as a control method related to a first circuit adapted to operate in a first operating mode, and not to operate in a second operating mode preceding the first operating mode or a control method related to a first circuit.

The above and other objects, characterizing features, aspects and advantages of the invention will be clear from the description of preferred embodiments presented below along with the attached Figures.

DETAILED DESCRIPTION OF THE PREFERRED EMBODIMENTS

Embodiments of the present invention will be described below with reference to the drawings.

A. Embodiments

Configuration of Digital Device

Figure 1:
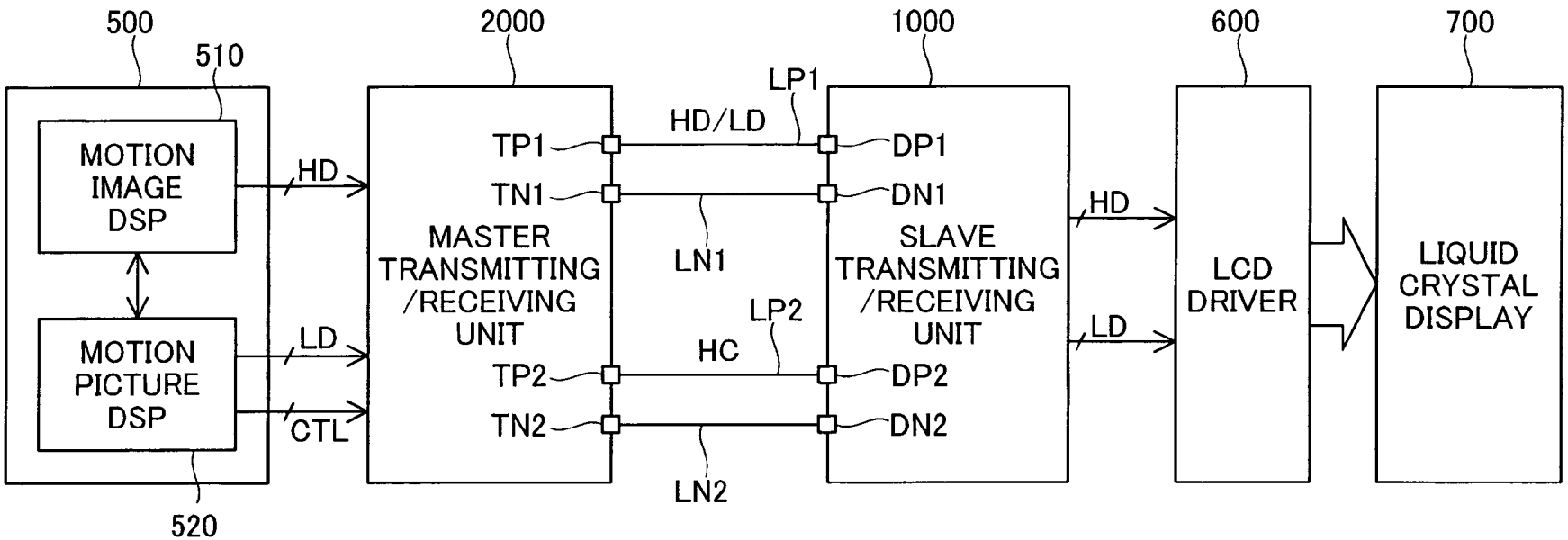
FIG. 1 is a schematic diagram of the digital device in the embodiment.

FIG. 1 is a schematic diagram of the digital device in the embodiment. As shown in FIG. 1, the digital device of the embodiment includes an image processing unit 500, a transmitting/receiving system composed of a master transmitting/receiving unit 2000 and a slave transmitting/receiving unit 1000, an LCD driver 600, and a liquid crystal display 700 as the display unit. This digital device is adapted for installation in electronic devices such as cell phones, and is used to display still images and motion images.

The image processing unit 500 performs image processing of image data acquired from other constitutional elements incorporated into the electronic device, for example, a wireless communication circuit or flash memory. The image processing unit 500 includes a DSP (Digital Signal Processor) 510, which is basically a computer specialized for image processing of motion image data; and a main controller 520 which is a computer for carrying out other processes (for example, processing of still images, and control processes for the LCD driver 600 and master transmitting/receiving unit 2000).

The image processing unit 500 outputs to the master transmitting/receiving unit 2000 data HD for transmission at high speed, and data LD for transmission at low speed. In the embodiment, the high speed transmission data HD is motion image data output by the DSP 510. In the embodiment, the low speed transmission data LD is data besides motion image data, for example, still image data or control data for the LCD driver 600. The image processing unit 500 also outputs a control signal CTL to the master transmitting/receiving unit 2000.

The transmitting/receiving system composed of the slave transmitting/receiving unit 1000 and the master transmitting/receiving unit 2000 constitutes an interface for transmitting data LD, HD received from the image processing unit 500, to the LCD driver in accordance with the control signal CTL from the image processing unit 500. The master transmitting/receiving unit 2000 has two pairs of transmission terminals for transmitting differential signals, namely, a terminal pair composed of terminals TP1, TN1 and a terminal pair composed of terminals TP2, TN2. The master transmitting/receiving unit 2000 can transmit single end signals and differential signals to slave transmitting/receiving unit 1000 via these terminals. The master transmitting/receiving unit 2000 can also receive single end signals from slave transmitting/receiving unit 1000 via these terminals.

The slave transmitting/receiving unit 1000 is provided with two pairs of transmission terminals corresponding respectively to the aforementioned terminal pairs, namely, a terminal pair composed of terminals DP1, DN1 and a terminal pair composed of terminals DP2, DN2. As shown in FIG. 1, the terminals TP1, TN1, TP2, TN2 of the master transmitting/receiving unit 2000 and the corresponding terminals DP1, DN1, DP2, DN2 of the slave transmitting/receiving unit 1000 are respectively connected by means of signal lines LP1, LN1, LP2, LN2. By means of this arrangement, the slave transmitting/receiving unit 1000 can receive differential signals and single end signals from the master transmitting/receiving unit 2000 via these signal lines. The slave transmitting/receiving unit 1000 can also transmit single end signals to the master transmitting/receiving unit 2000 via these signal lines.

The LCD driver 600 receives image data and control data from the image processing unit 500 via the transmitting/receiving system, and drives the liquid crystal display 700 on the basis of this data.

Figure 2:
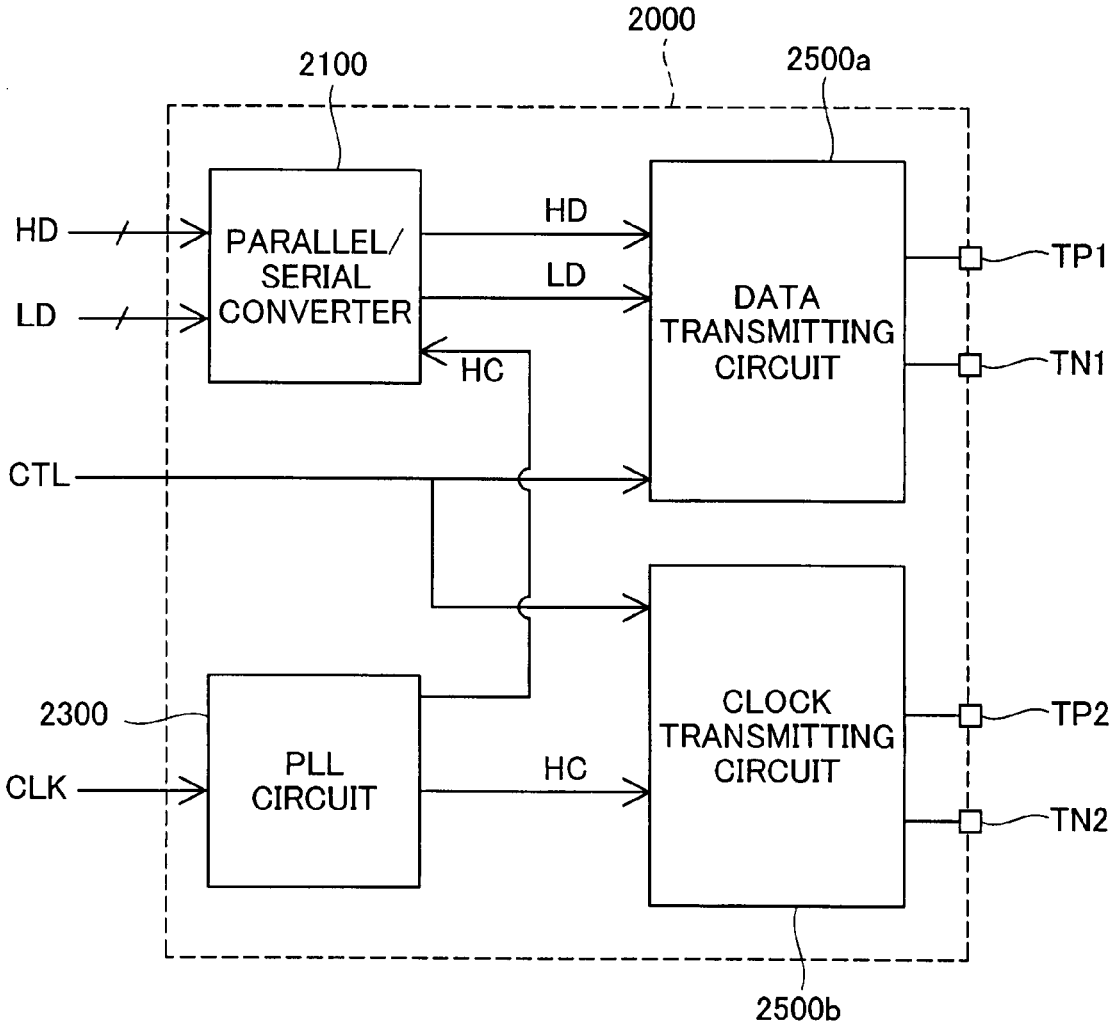
FIG. 2 is an illustration of the internal configuration of the master transmitting/receiving unit.
Figure 3:
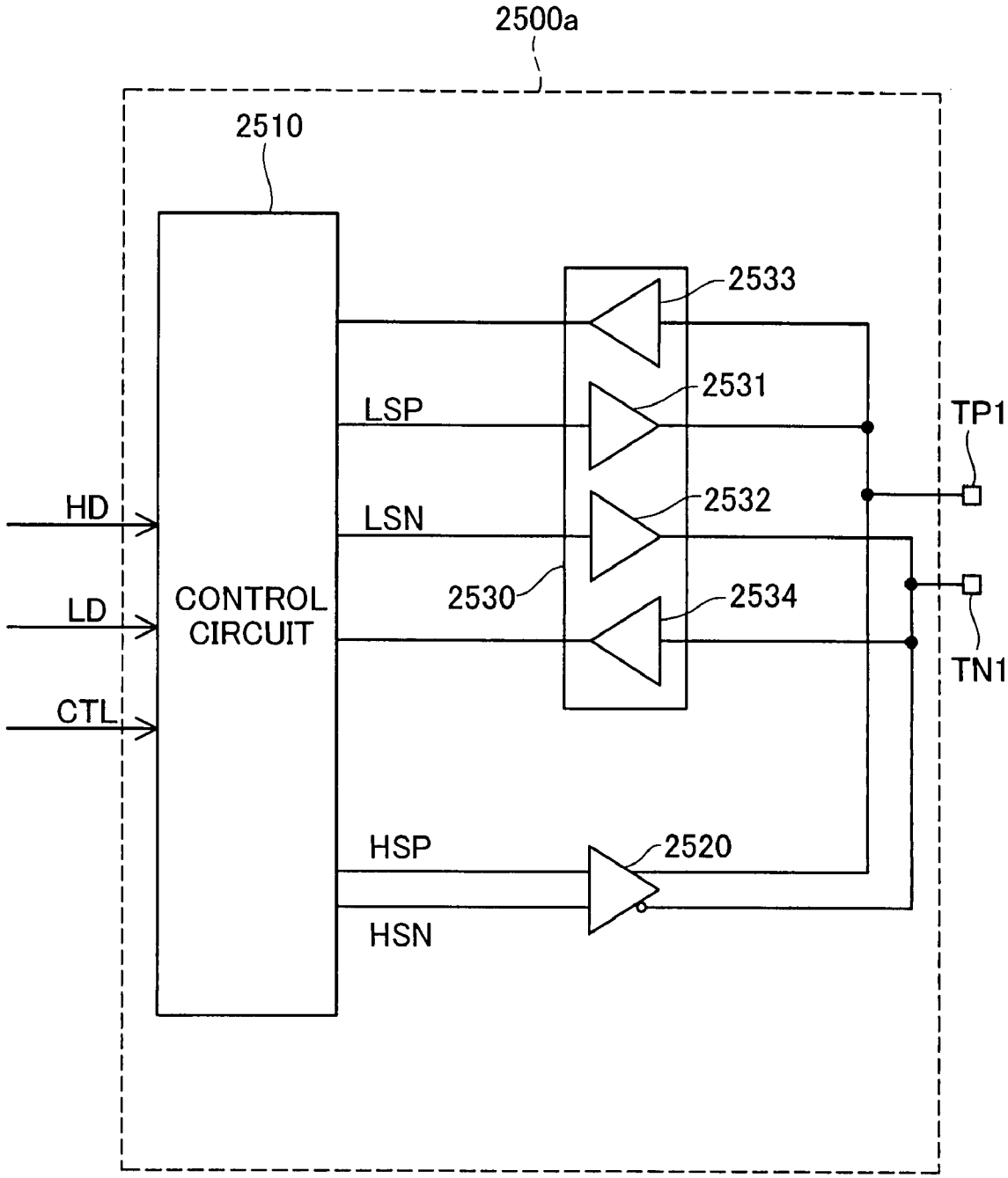
FIG. 3 is an illustration of the internal configuration of a data transmitting circuit.

Configuration of Master Transmitting/Receiving Unit:

The configuration of the master transmitting/receiving unit 2000 will be described in further detail with reference to FIGS. 2 and 3. FIG. 2 is an illustration of the internal configuration of the master transmitting/receiving unit. FIG. 3 is an illustration of the internal configuration of a data transmitting circuit.

As shown in FIG. 2, in addition to the terminals TP1, TN1, TP2 and TN2 discussed previously, the master transmitting/receiving unit 2000 also includes a parallel/serial converter 2100, a PLL (Phase Locked Loop) circuit 2300, a data transmitting circuit 2500*a*, and a clock transmitting circuit 2500*b*. The PLL circuit 2300 receives a reference clock signal CLK and generates a high-speed transfer clock HC. The parallel/serial converter 2100 converts to serial data the parallel data HD, LD that has been received from the image processing unit 500, and sends the serial data to the data transmitting circuit 2500*a*. Data HD intended for high-speed transmission will undergo parallel/serial conversion in sync with the high-speed transfer clock HC.

In response to a control signal CTL, the data transmitting circuit 2500*a* performs high-speed transmission of data HD intended for transmission at high speed, or low-speed transmission of data LD intended for transmission at low speed. Specifically, as shown in FIG. 3, the data transmitting circuit 2500*a* includes a control circuit 2510, a differential driver 2520, and a single end transmitting/receiving circuit 2530.

The control circuit 2510 receives a control signal CTL requesting high-speed transmission and data HD intended for high-speed transmission, and outputs signals HSP, HSN for driving the differential driver 2520. The signal HSP and the signal HSN have mutually opposite phases. The differential driver 2520 receives the drive signals HSP, HSN, and outputs a differential signal over signal lines LP1, LP2 via the terminals TP1, TN1. The data HD, in the form of a differential signal, is thereby sent to the slave transmitting/receiving unit 1000. The differential driver 2520 includes, for example, a typical differential amplifier circuit composed of a constant current source and an n-channel field effect transistor, not shown. Herein, a n-channel field effect transistor will be referred as an n transistor, and a p-channel field effect transistor will be referred as a p transistor.

The control circuit 2510 also receives a control signal CTL requesting low-speed transmission and data LD intended for low-speed transmission, and outputs signals LSP, LSN for driving the single end transmitting/receiving circuit 2530. The single end transmitting/receiving circuit 2530 includes a single end driver 2531 that inputs the signal LSP, and a single end driver 2532 that inputs the signal LSN. The single end drivers 2531, 2532 are push pull inverter circuits driven by a adjusting voltage VLS (1.2 V in the present embodiment) and a reference voltage VSS (0 V ground voltage in the present embodiment). In response to the drive signal LSP, the single end driver 2531 outputs a single end signal LS over the signal line LP1 via the terminal TP1. In response to the drive signal LSN, the single end driver 2532 outputs a single end signal LS over the signal line LN1 via the terminal TN1. The data LD, in the form of two single end signals, is thereby sent to the slave transmitting/receiving unit 1000.

The single end transmitting/receiving circuit 2530 also includes a single end receiver 2533 connected with the terminal TP1, and a single end receiver 2534 connected with the terminal TN1. The single end receivers 2533, 2534 employ a configuration in which a CMOS inverter is furnished in the input stage, for example. Independently, the single end receiver 2533 receives a single end signal LS from the slave transmitting/receiving unit 1000 via the terminal TP1, while the single end receiver 2534 receives a signal via the terminal TN1.

Figure 4:
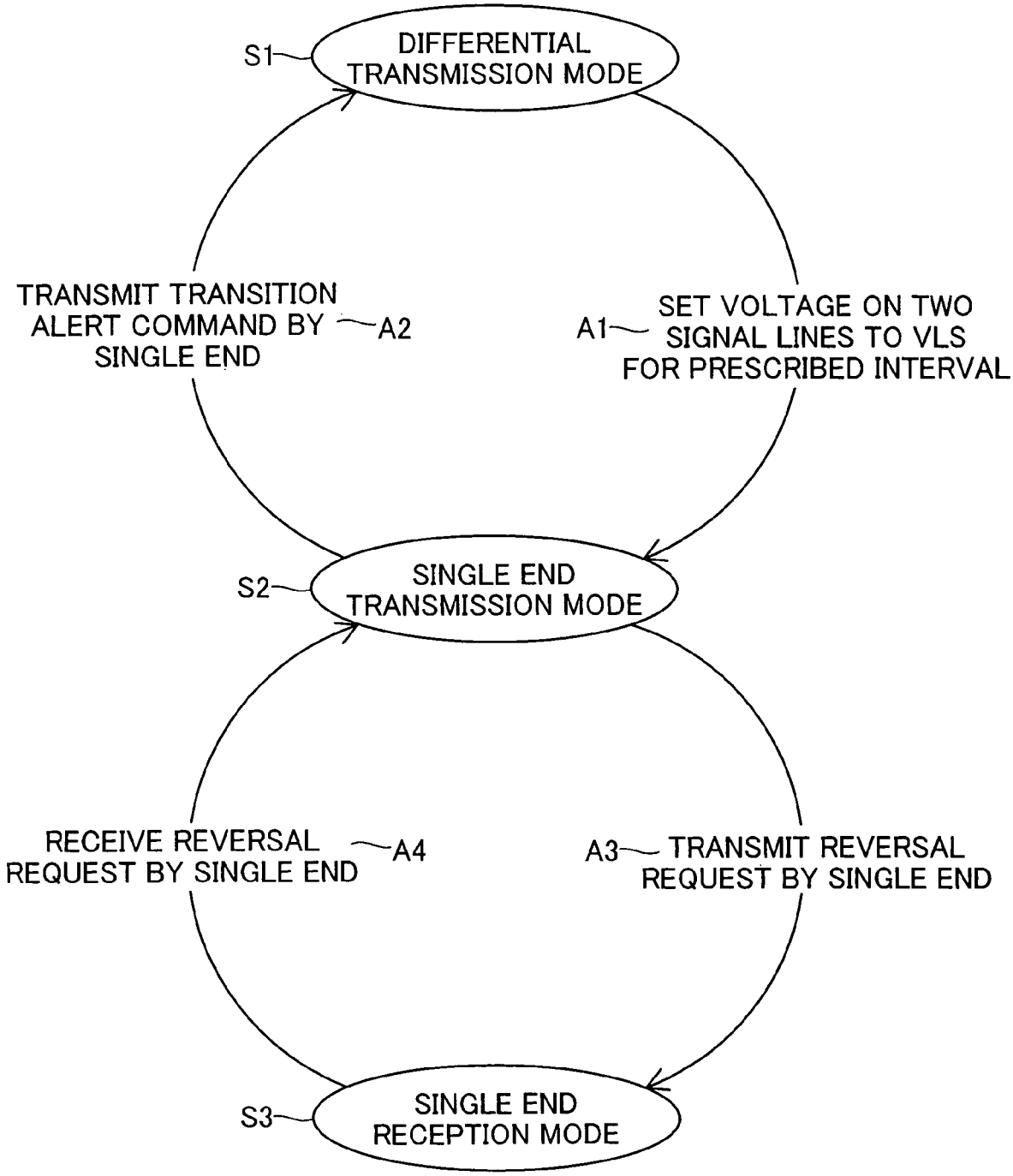
FIG. 4 is a schematic diagram depicting state transitions of the data transmitting circuit.
Figure 5:
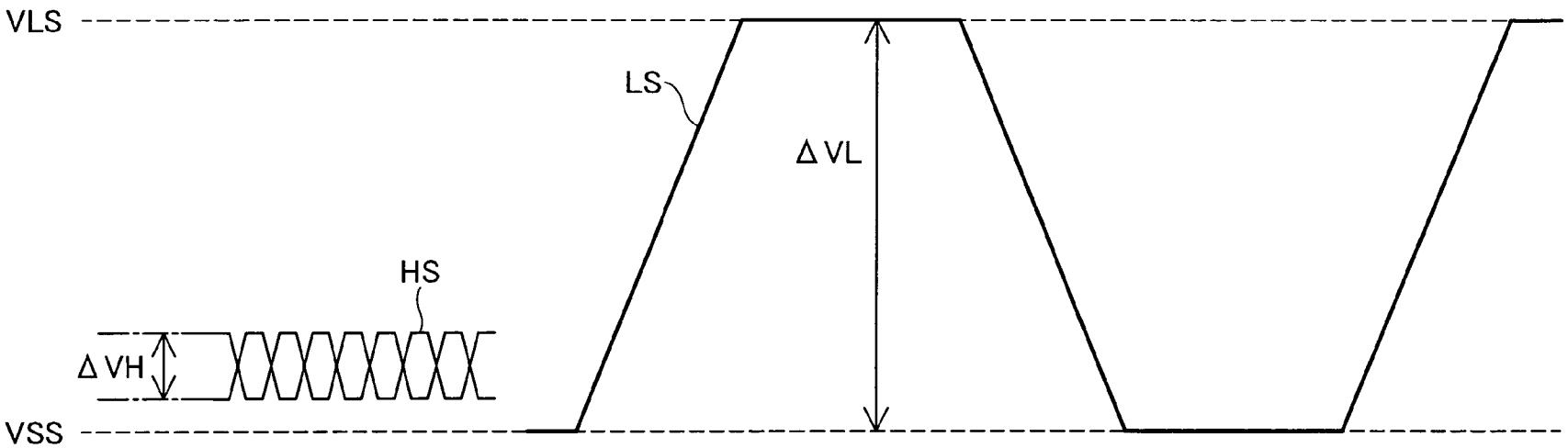
FIG. 5 is a schematic diagram describing the differential signal and the single end signals.

Operation of Master Transmitting/Receiving Unit:

First, operation of the data transmitting circuit 2500*a* will be discussed with reference to FIGS. 4 and 5. FIG. 4 is a schematic diagram depicting state transitions of the data transmitting circuit. FIG. 5 is a schematic diagram describing the differential signal and the single end signals.

As shown in FIG. 4, the data transmitting circuit 2500*a* has as its operating modes a differential transmission mode S1 in which data HD is transmitted at high speed by means of a differential signal HS; a single end transmission mode S2 in which data LD is transmitted at low speed by means of two single end signals LS; and a single end reception mode S3 in which single end signals LS are received from the slave transmitting/receiving unit 1000. The amplitude ΔVH of the differential signal HS transmitted from the data transmitting circuit 2500*a* in the differential transmission mode S1 is set to about 200 mV, for example. On the other hand, the single end signals LS transmitted from the data transmitting circuit 2500*a* in the single end transmission mode S2 or received by the data transmitting circuit 2500*a* in the single end reception mode S3 have the reference voltage VSS in the low signal state and the adjusting voltage VLS in the high signal state (FIG. 5). The amplitude ΔVL (VLS−VSS) of the single end signal is set to about four to ten times the amplitude ΔVH of the differential signal, for example, to about 1.2 V.

The transfer rate of the differential signal HS is set to about 500 Mb/s (megabits/second) for example; while the transfer rate of the single end signals LS is set to about 10 Mb/s for example.

The reason for using the single end signals LS for low-speed data transmission and the differential signal HS for high-speed data transmission in the present embodiment will now be discussed. Transmission of the single end signals LS is performed by the push-pull circuit mentioned earlier, and the internal current of this circuit will increase in proportion to transmission rate. Also, the nature of single end signals LS is such that the transfer rate cannot be increased to very high speed.

Transmission of the differential signal HS, on the other hand, is performed by the differential amplifier circuit mentioned earlier. A feature of the differential amplifier circuit is that its internal current does not change appreciably regardless of whether the transmission rate is high or low. Moreover, with the differential signal HS it is easier to increase the transfer rate than with the single end signal LS. From this standpoint, it is more advantageous to employ the differential signal HS for data transmission at relatively high transfer rates (e.g. 500 Mb/s). On the other hand, from a internal current standpoint, it will sometimes be more advantageous to employ single end signals LS for data transmission at relatively low transfer rates (e.g. 10 Mb/s). For this reason, in the present embodiment, the single end signals LS and the differential signal HS are employed selectively depending on transfer speed.

The single end reception mode S3 is used, for example, during reception from the slave transmitting/receiving unit 1000 of a response to a control command that was sent from the master transmitting/receiving unit 2000 to the slave transmitting/receiving unit 1000.

Transitions among modes in the data transmitting circuit 2500*a* are controlled by means of the control signal CTL from the transmission control circuit 2510. When the data transmitting circuit 2500*a* transitions from the differential transmission mode S1 to the single end transmission mode S2, during the transition interval, voltage on the signal line LP1 and on the signal line LN1 will be held at VLS (the High signal of the single end signal) for a prescribed time interval (FIG. 4: A1).

On the other hand, when the data transmitting circuit 2500*a* transitions from the single end transmission mode S2 to the differential transmission mode S1, during the transition interval, a prescribed transition alert command CM1 will be transmitted to the slave transmitting/receiving unit 1000 by means of the single end signals (FIG. 4: A2). The transition alert command CM1 is 8-bit data representing "11111111" for example.

When the data transmitting circuit 2500*a* transitions from the single end transmission mode S2 to the single end reception mode S3, during the transition interval, a prescribed reversal request CM2 will be transmitted to the slave transmitting/receiving unit 1000 by means of the single end signals (FIG. 4: A3).

In the single end reception mode S3, when the data transmitting circuit 2500*a* receives the prescribed reversal request CM2 from the slave transmitting/receiving unit 1000 by means of the single end signals (FIG. 4: A4), it will transition from the single end reception mode S3 to the single end transmission mode S2.

The clock transmission circuit 2500*b* transmits the differential signal HS and transmits/receives the single end signals LS via the terminals TP2 and TN2. In the differential transmission mode S1, the clock transmission circuit 2500*b* transmits, in the form of a differential signal HS, the high speed transfer clock HC supplied by the PLL circuit 2300; in this respect the circuit differs from the data transmitting circuit 2500*a* which transmits the data HD as a differential signal HS. In the single end transmission mode S2, the clock transmission circuit 2500*b* does not transmit any data for sending to the LCD driver 600. The data transmitting circuit 2500*a* transmits, as single end signals LS, only control commands (e.g. the transition alert command discussed earlier) directed to the slave transmitting/receiving unit 1000. The internal configuration of the clock transmission circuit 2500*b* is basically similar to the configuration of the data transmitting circuit 2500*a* discussed with reference to FIG. 3, and will therefore not be described in detail. The operation of the clock transmission circuit 2500*b* is similar to the operation of the data transmitting circuit 2500*a* discussed with reference to FIGS. 4 and 5, and will therefore not be described in detail.

Figure 6:
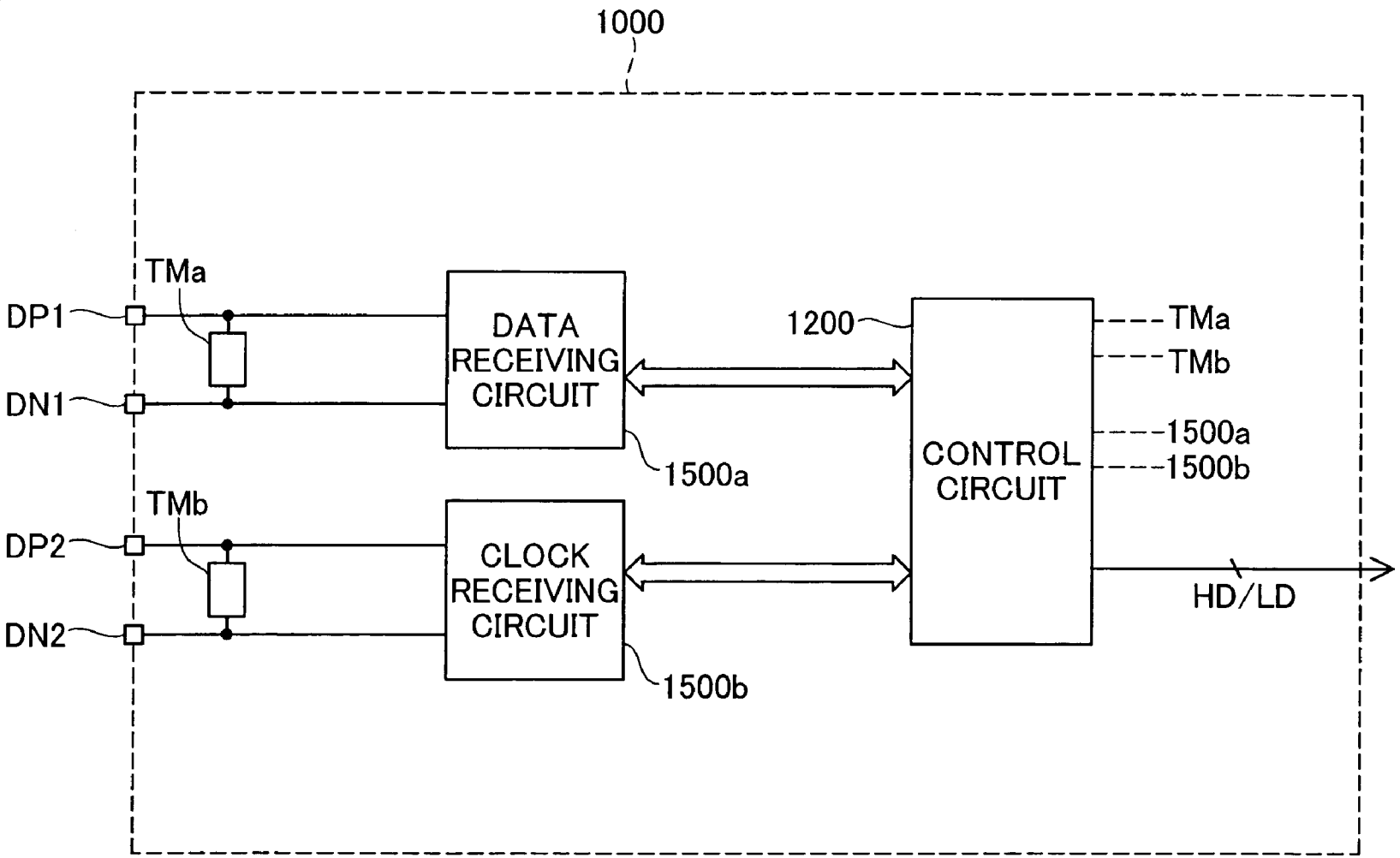
FIG. 6 is an illustration depicting the internal configuration of the slave transmitting/receiving unit.
Figure 7:
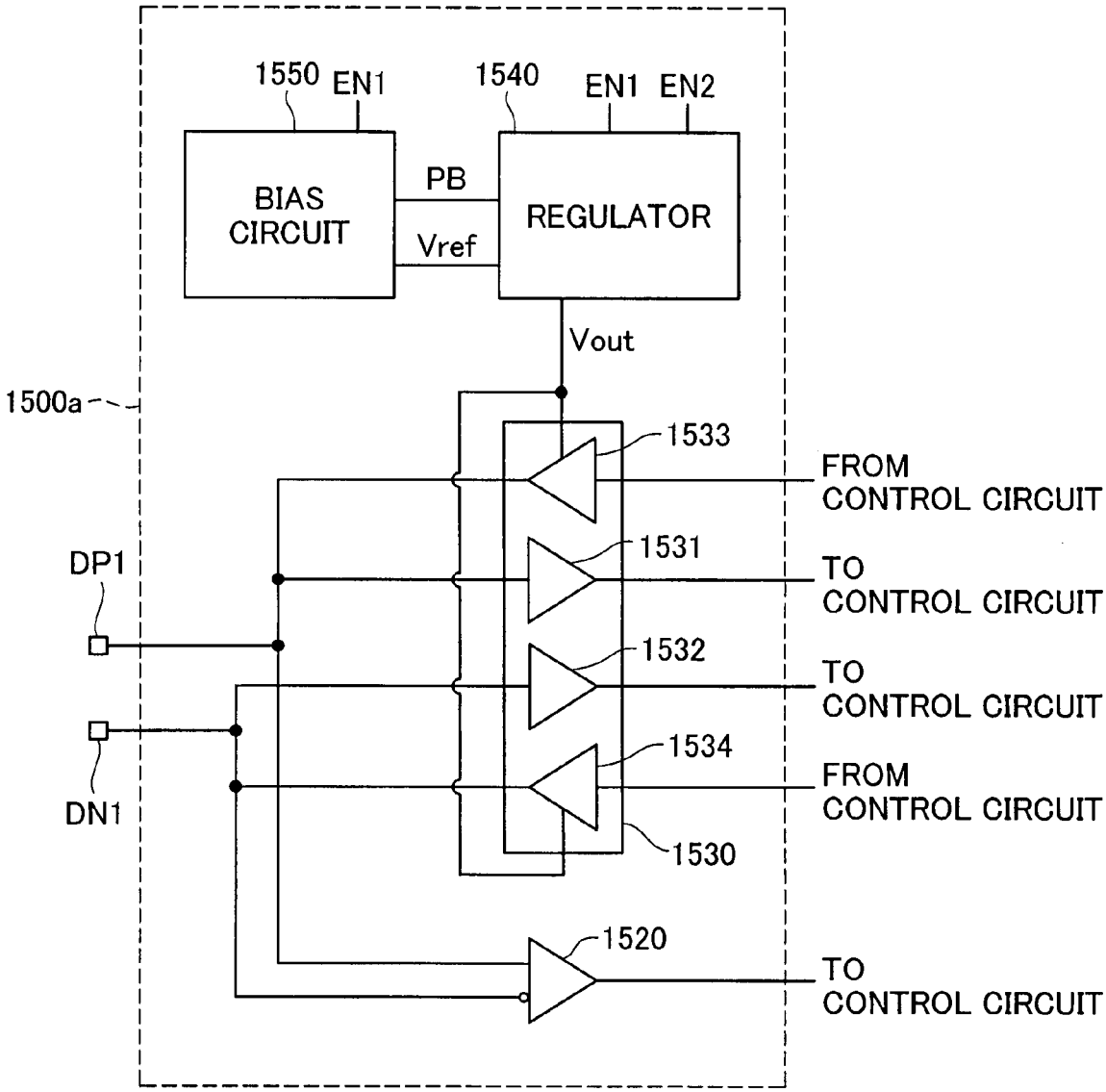
FIG. 7 is an illustration depicting the internal configuration of the data receiving circuit.
Figure 8:
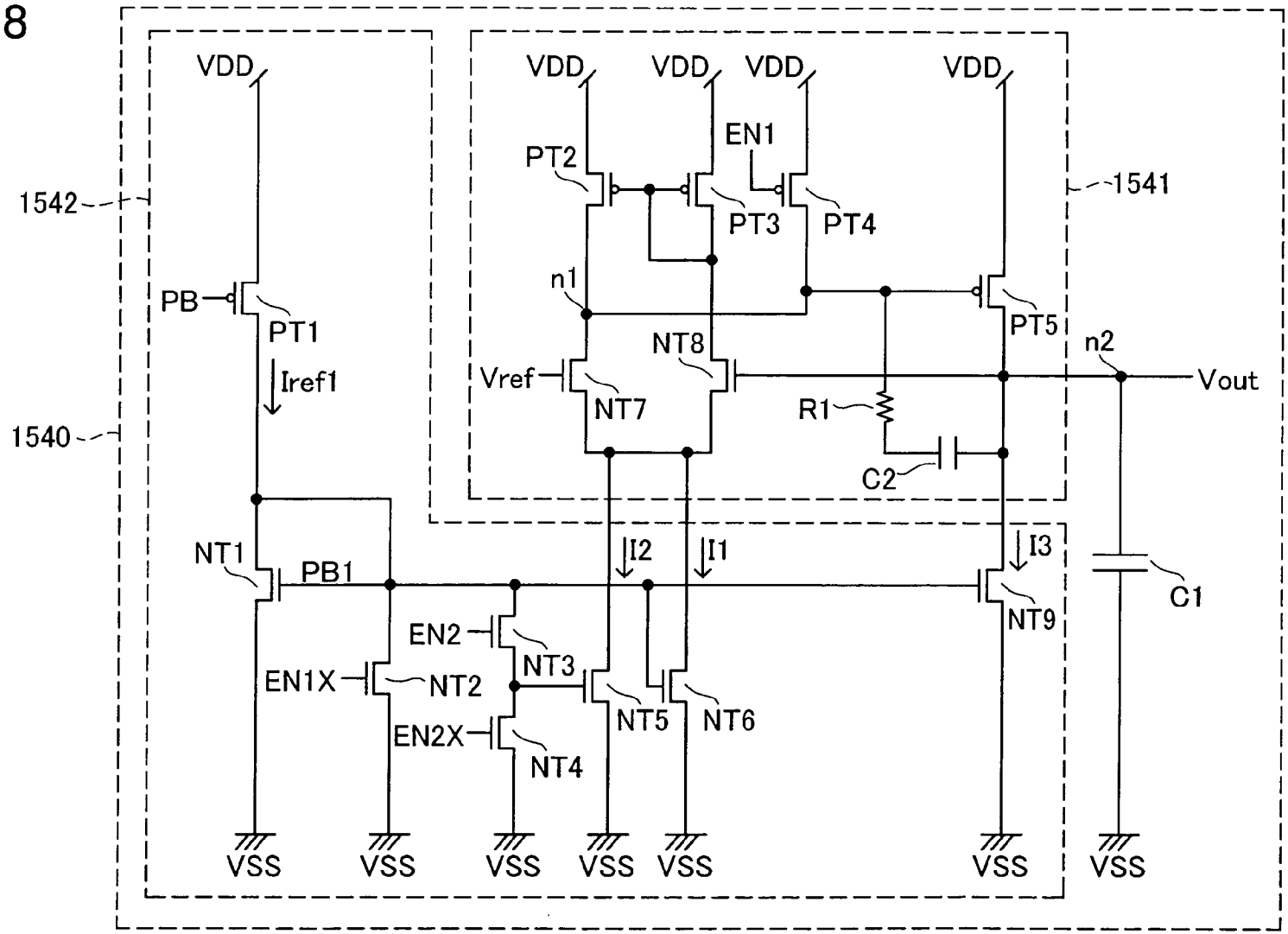
FIG. 8 is a circuit diagram illustration depicting the internal configuration of the regulator.
Figure 9:
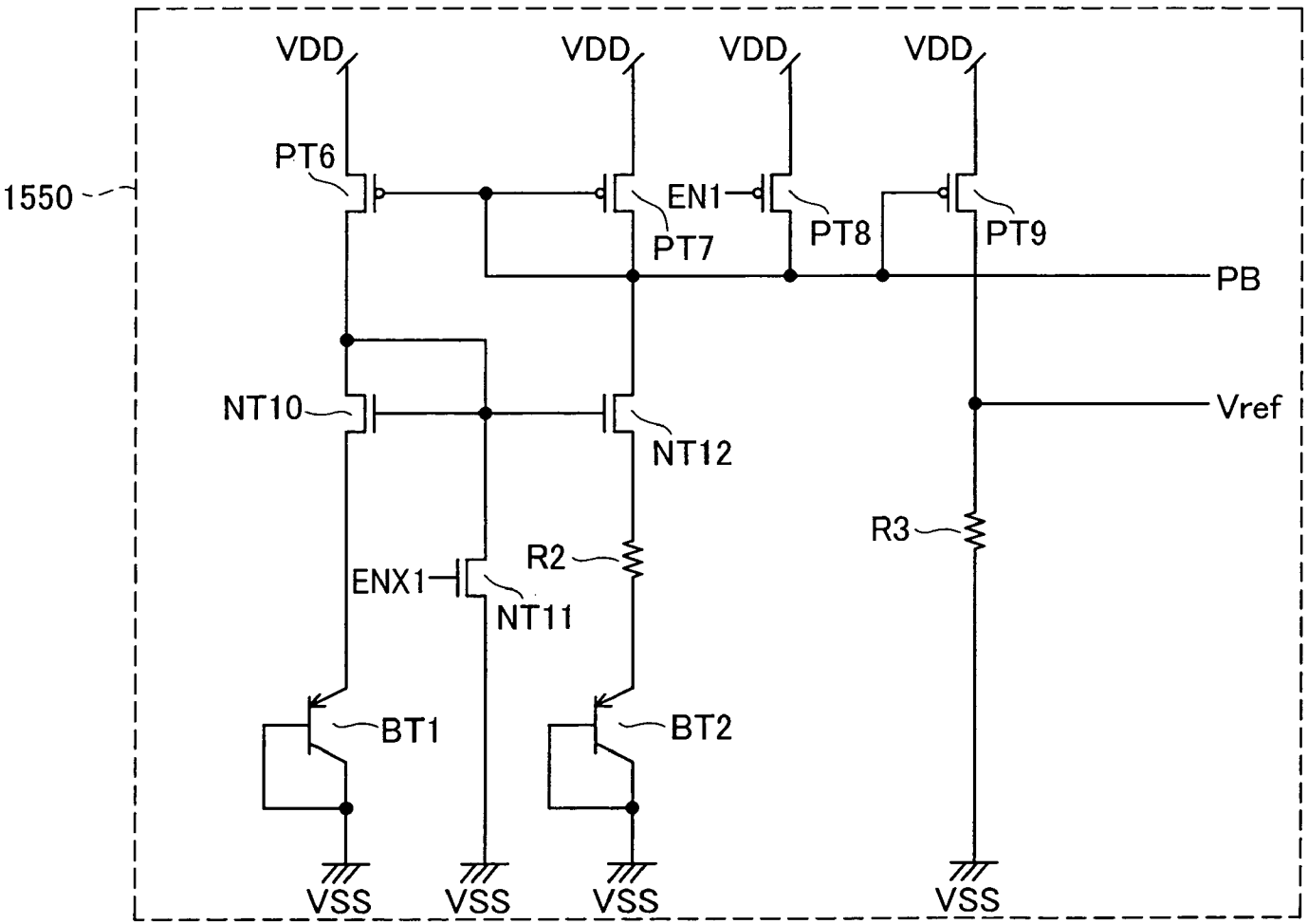
FIG. 9 is a circuit diagram illustration depicting the internal configuration of the bias circuit.

Configuration of Slave Transmitting/Receiving Unit:

Next, the configuration of the slave transmitting/receiving unit 1000 will be described in further detail with reference to FIGS. 6 through 9. FIG. 6 is an illustration depicting the internal configuration of the slave transmitting/receiving unit. FIG. 7 is an illustration depicting the internal configuration of the data receiving circuit. FIG. 8 is a circuit diagram illustration depicting the internal configuration of the regulator. FIG. 9 is a circuit diagram illustration depicting the internal configuration of the bias circuit.

As shown in FIG. 6, the slave transmitting/receiving unit 1000 has termination circuits TMa, TMb; a data receiving circuit 1500*a*; a clock receiving circuit 1500*b*; and a control circuit 1200.

The termination circuit TMa is a circuit for terminating the differential signal HS received via the terminal pair composed of the terminals DP1 and DN1. Upon receiving a differential signal HS, under control by the control circuit 1200 the termination circuit TMa will connect the terminal DP1 and the terminal DN1 across termination resistance on the order of 100Ω; and when transmitting/receiving single end signals LS will respectively place the terminal DP1 and the terminal DN1 in a high impedance state.

The other termination circuit TMb is a circuit for terminating the differential signal HS received via the terminal pair composed of the terminals DP2 and DN2. The configuration of the termination circuit TMb is similar to that of the termination circuit TMa described above and requires no discussion.

The control circuit 1200 is a logic circuit that primarily carries out a serial/parallel conversion process for converting, from serial data to parallel data, signals received from the data receiving circuit 1500*a*; and a so-called protocol process for extracting data HD and data LD from the converted parallel data and transferring the data to the LCD driver 600.

Using Enable signals EN1, EN2 etc. to be discussed later, the control circuit 1200 also controls the termination circuits TMa, TMb, the data receiving circuit 1500*a*, and the clock receiving circuit 1500*b*.

The data receiving circuit 1500*a* is a circuit for receiving the differential signal HS and the single end signals LS via the terminal pair composed of the terminals DP1 and DN1 to accept the aforementioned data HD and LD from the data transmitting circuit 2500*a*. As shown in FIG. 9, the data receiving circuit 1500*a* has a differential receiver 1520, a single end transmitting/receiving circuit 1530, a regulator 1540, and a bias circuit 1550.

The differential receiver 1520 is connected to the two terminals DP1 and DN1. The differential receiver 1520 has a configuration of known type with a differential amplifier circuit as the principal component; it converts the differential signal HS input via the two terminals DP1 and DN1 (the signal line LP1 and the signal line LN1) into single end signals.

The single end transmitting/receiving circuit 1530 includes a single end receiver 1531 connected with the terminal DP1, and a single end receiver 1532 connected with the terminal DN1. The single end receivers 1531, 1532 employ a configuration in which a CMOS inverter is furnished in the input stage, for example. Independently, the single end receiver 1531 receives a single end signal LS from the master transmitting/receiving unit 2000 via the terminal DP1, while the single end receiver 1532 receives a signal via the terminal DN1.

The single end transmitting/receiving circuit 1530 further includes single end drivers 1533, 1534. The single end drivers 1533, 1534 are push pull inverter circuits driven by the adjusting voltage VLS and the reference voltage VSS. In response to a drive signal input from the control circuit 1200, the single end driver 1533 outputs a single end signal LS via the terminal DP1. In response to a drive signal input from the control circuit 1200, the single end driver 1534 outputs a single end signal LS via the terminal DN1. The slave transmitting/receiving unit 1000 thereby transmits responses to control commands and the like, in the form of single end signals LS, to the master transmitting/receiving unit 2000.

The regulator 1540 is a circuit for converting the power supply voltage VDD (in the embodiment, 1.8 V) to the aforementioned adjusting voltage VLS (in the embodiment, 1.2 V). The reason for providing the regulator 1540 is that the power supply voltage VDD does not match the adjusting voltage VLS, which corresponds to the high level voltage of the single end signal LS. The power supply voltage VDD will be set, for example, with reference to the process generation of the control circuit 1200 making up the slave transmitting/receiving unit 1000, the LCD driver 600, and so on; whereas the high level of the single end signal LS will in some instances be set according to standards specified for the signal transfer format. In such cases, the power supply voltage VDD and the adjusting voltage VLS may differ.

By means of the two Enable signals EN1, EN2, the regulator 1540 is controlled among three states. The three states are: a fully stopped state in which the Enable signal EN1 is Low; a standby state in which the Enable signals EN1=High and EN2=Low; and a load driving state in which the Enable signals EN1=High and EN2=High. The fully stopped state is a state in which the functions of the regulator 1540 are Off. The load driving state is a state enabling output of sufficiently stabilized voltage output Vout during operation of the single end drivers 1533, 1534 to which the voltage output Vout is output. The standby state is a state in which internal current of the regulator 1540 (consumption current of the regulator) is held to a lower level than in the load driving state. The specific arrangements for producing these states will be discussed below.

As shown in FIG. 8, the regulator 1540 includes an output controller 1541 for controlling the voltage output Vout to the aforementioned adjusting voltage VLS, and an electric current source 1542 functioning as the source of electric current for driving the output controller 1541.

As shown in FIG. 8, the output controller 1541 includes p transistors PT2, PT3 constituting a current mirror; a differential amplifier circuit composed of n transistors NT7, NT8 constituting a differential pair; and a p transistor PT5 for controlling the voltage output Vout with reference to the output of the differential amplifier circuit. The differential amplifier circuit is a circuit that amplifies and outputs the differential between voltage input to a first input terminal and voltage input to a second input terminal. A voltage reference Vref output from the bias circuit 1550 is input to the gate of the n transistor NT7 which is the first input terminal of the differential amplifier circuit. The voltage output Vout is input to the gate of the n transistor NT8 which is the second input terminal of the differential amplifier circuit. The voltage output from an output node n1 of the differential amplifier circuit is input to the gate of the p transistor PT5. As a result, the drain current of the p transistor PT5 is controlled in such as way that the voltage output Vout is the same as the voltage reference Vref. In the present embodiment, 1.2 V voltage output Vout is output by means of inputting 1.2 V voltage reference Vref to the regulator 1540.

The output controller 1541 is also furnished with a resistor R1 and a capacitor C2 for the purpose of phase compensation; and a p transistor PT4 as an Enable switch. The p transistor PT4 enables output by the differential amplifier circuit when the Enable signal EN1 is High, and disables output by the differential amplifier circuit when the Enable signal is Low.

The electric current source 1542 is furnished with a p transistor PT1 to whose gate a current control voltage PB from the bias circuit 1550 is input and which generates a constant current Iref1; and an n transistor NT1 that is diode-connected so as to output from its gate a current control voltage PB1 dependent on the constant current Iref1.

The electric current source 1542 is additionally provided with n transistors NT5, NT6, NT9 that function as constant current sources by means of input of the current control voltage PB1 to their gates. The n transistor NT5 and the n transistor NT6 function as a constant current source for the differential amplifier circuit of the output controller 1541. The n transistor NT9 functions as a constant current source for the p transistor PT5 of the aforementioned output controller 1541.

In the electric current source 1542, the n transistors NT2, NT3, NT4 are Enable switches. The n transistor NT2 is controlled by an inverted signal EN1X of the Enable signal EN1; the n transistor NT3 is controlled by the Enable signal EN2; and n transistor NT4 is controlled by an inverted signal EN2X of the Enable signal EN2.

When the Enable signal EN1 is Low, function of the n transistors NT5, NT6, NT9 as constant current sources is disabled, and electric currents I1, I2, I3 in FIG. 8 respectively go to zero.

When the Enable signal EN1 is High and the Enable signal EN2 is Low, function of the n transistors NT6 and NT9 as constant current sources is enabled, and function of the n transistor NT5 as a constant current source is disabled. Consequently, electric currents I1, I2, I3 in FIG. 8 respectively go to Ia, 0, and Ic. Ia and Ic are constant values determined in a manner dependent on the characteristics of the respective transistors NT6, NT9.

When the Enable signals EN1 and EN2 are both High, function of each of the transistors NT5, NT6, and NT9 as a constant current source is enabled. Consequently, electric currents I1, I2, I3 in FIG. 8 respectively go to Ia, Ib, and Ic. Ib is a constant value determined in a manner dependent on the characteristics of the transistor NT5.

As will be apparent from the preceding description, in the fully stopped state (EN1=Low), supply of electric current to the output controller 1541 is stopped. In the standby state (EN1=High, EN2=Low), the differential amplifier circuit of the output controller 1541 will be driven by the constant current Ia. On the other hand, in the load driving state (EN1=EN2=High), the differential amplifier circuit of the output controller 1541 will be driven by the constant current (Ia+Ib). In the present embodiment, by appropriately establishing Ia, Ib, and Ic, the internal current of the regulator 1540 in the standby state is set to about several μA to 10 μA, and in the load driving state to about several hundred μA.

In the regulator 1540, a bypass capacitor C1 is disposed between the reference voltage VSS and the node n2 on the line over which the voltage output Vout is output. The bypass capacitor C1 is a capacitor for the purpose of stabilizing the voltage output Vout, and stabilizing operation of the single end drivers 1533, 1534 as a result. The bypass capacitor C1 has a capacity of about 1000 pF, for example.

The bias circuit 1550 is a circuit for the purpose of generating the current control voltage PB and the voltage reference Vref supplied to the regulator 1540 discussed above. The bias circuit 1550 is a circuit of a type referred to as a band gap reference circuit. As shown in FIG. 9, the bias circuit 1550 is furnished with p transistors PT6, PT7 constituting a current mirror, and with n transistors NT10, NT12 likewise constituting a current mirror. A diode-connected bipolar transistor BT1 is connected between the reference voltage VSS and the source of the n transistor NT10. A resistor R2 and a diode-connected bipolar transistor BT2 are series-connected between the reference voltage VSS and the source of the n transistor NT12.

By means of the two current mirrors mentioned above, the source voltage Vm of the n transistor NT10 and the source voltage Vn of the n transistor NT12 are equal; and the collector current Im of the bipolar transistor BT1 and the collector current In of the bipolar transistor BT2 are equal. The bipolar transistor BT2 is either a transistor with an emitter region several times larger than that of the bipolar transistor BT1, or is composed of several parallel-connected bipolar transistors BT1. Consequently, though the electric current flowing through them is the same, the voltage drop in the bipolar transistor BT2 will be several times smaller than the voltage drop in the bipolar transistor BT1.

This circuit is stabilized at current lm=ln and voltage Vm=Vn, so that the sum of the voltage drop in the resistor R2 and the voltage drop in the bipolar transistor BT2 is equal to the voltage drop in the bipolar transistor BT1. The current control voltage PB output by the bias circuit 1550 is also stabilized to constant potential thereby.

By inputting the current control voltage PB to its gate, the p transistor PT9 functions as constant current source. A resistor R3 is connected between the p transistor PT9 and the reference voltage VSS. The desired voltage reference Vref (1.2 V in the present embodiment) can be produced by employing a resistor of appropriate resistance as the resistor R3. The n transistor nT11 and the p transistor PT9 are Enable switches; when EN1=High, operation of the bias circuit 1550 is enabled, and when EN1=Low, operation of the bias circuit 1550 is disabled.

Operation of Slave Transmitting/Receiving Unit

Figure 10:
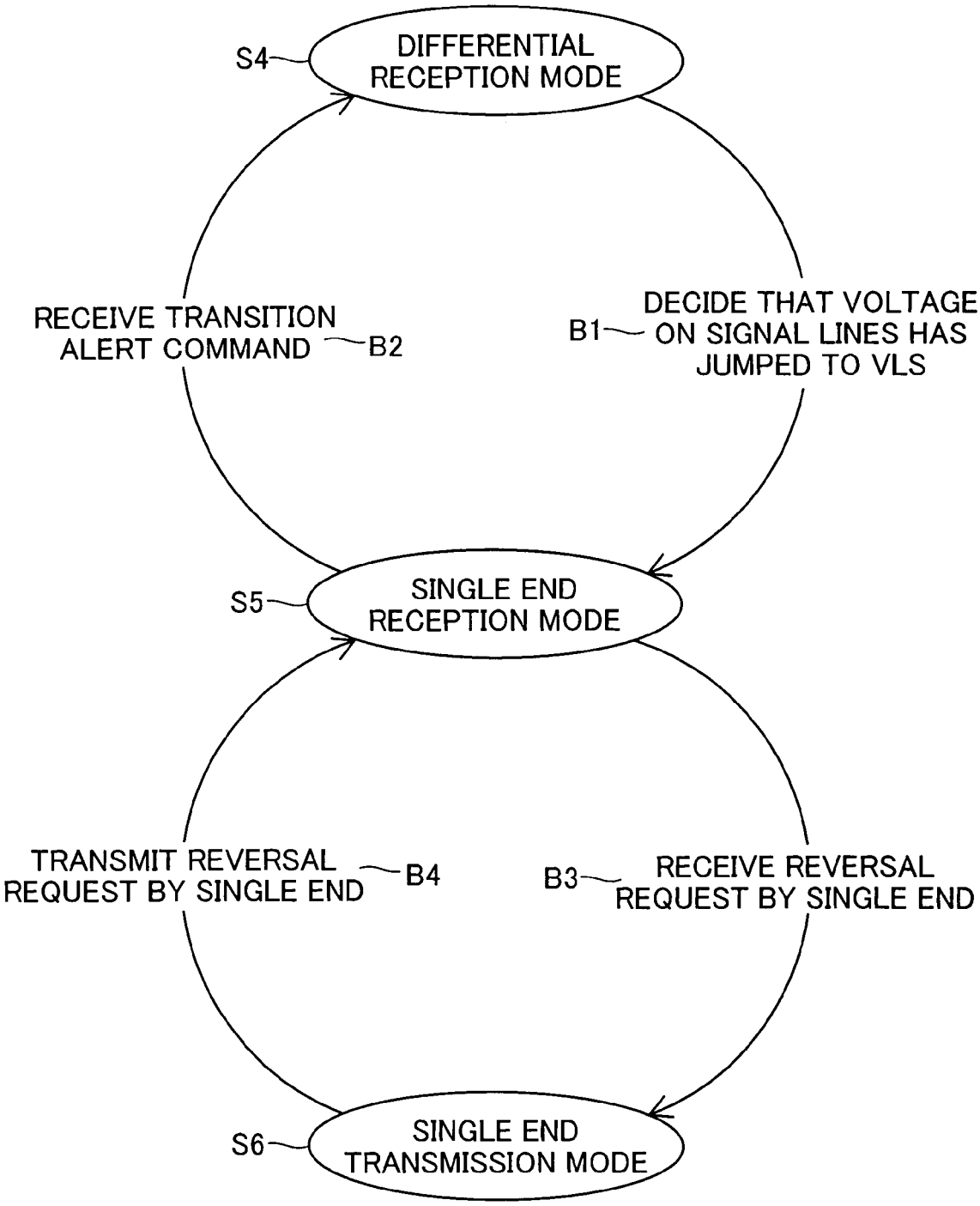
FIG. 10 is a schematic diagram depicting state transitions of the data receiving circuit.

Next, the operation of the slave transmitting/receiving unit 1000 will be described with reference to FIGS. 10 to 12. FIG. 10 is a schematic diagram depicting state transitions of the data receiving circuit. FIG. 11 is a timing chart illustrating operation of the transmitting/receiving system. FIG. 12 is a schematic diagram depicting state transitions of the regulator.

As shown in FIG. 10, the data receiving circuit 1500*a* has as its operating modes a differential reception mode S4 in which data HD is received as a differential signal HS; a single end reception mode S5 in which data LD is received as two single end signals LS; and a single end reception mode S6 in which responses to control commands and the like are transmitted as single end signals LS to the master transmitting/receiving unit 2000.

Transitions among modes in the data receiving circuit 1500*a* are controlled by means of the control circuit 1200. When the mode of the data receiving circuit 1500*a* is the differential reception mode S4, if on the basis of output from the data receiving circuit 1500*a* the control circuit 1200 decides that the voltage on the terminal DP1 and the terminal DN1 (the voltage on the signal line LP1 and on the signal line LN1) has jumped to the voltage VLS level (FIG. 10: B1), the mode of the data receiving circuit 1500*a* will be transitioned to the single end reception mode S5. Specifically, when the control circuit 1200 has detected transition of the mode of the data transmitting circuit 2500*a* from the differential transmission mode S1 to the single end transmission mode S2, the mode of the data receiving circuit 1500*a* will transition from the differential reception mode S4 to the single end reception mode S5.

On the other hand, when the mode of the data receiving circuit 1500*a* is the single end reception mode S5, if the control circuit 1200 receives a prescribed transition alert command CM1 included in the output of the data receiving circuit 1500*a* (FIG. 10: B2), the mode of the data receiving circuit 1500*a* will be transitioned to the differential reception mode S4. Specifically, when the control circuit 1200 has detected transition of the mode of the data transmitting circuit 2500*a* from the single end transmission mode S2 to the differential transmission mode S1, the mode of the data receiving circuit 1500*a* will transition from the single end reception mode S5 to the differential reception mode S4.

When the mode of the data receiving circuit 1500*a* is the single end reception mode S5, if the control circuit 1200 receives a prescribed reversal request CM2 included in the output of the data receiving circuit 1500*a* (FIG. 10: B3), the mode of the data receiving circuit 1500*a* will be transitioned to the single end transmission mode S6. Specifically, when, through receipt of the reversal request CM2, the control circuit 1200 has detected transition of the mode of the data transmitting circuit 2500*a* from the single end transmission mode S2 to the single end reception mode S4, the mode of the data receiving circuit 1500*a* will transition from the single end reception mode S5 to the single end transmission mode S6.

When the data receiving circuit 1500*a* transitions from the single end transmission mode S6 to the single end reception mode S5, during this transition interval, the prescribed reversal request CM2 will be transmitted to the master transmitting/receiving unit 2000 by means of single end signals (FIG. 10: B4).

Next, the operation when the data receiving circuit 1500*a* transitions from the single end reception mode S5 to the single end transmission mode S6 will be discussed in greater detail with reference to FIG. 11. FIG. 11A depicts a timing chart showing the signal (voltage) output over the signal line LP1 by the single end driver 2531, and a timing chart showing the signal output over the signal line LN1 by the single end driver 2532, in the data transmitting circuit 2500*a* of the master transmitting/receiving unit 2000. FIG. 11B depicts a timing chart showing the signal output over the signal line LP1 by the single end driver 1533, and a timing chart showing the signal output over the signal line LN1 by the single end driver 2532, in the data receiving circuit 1500*a* of the slave transmitting/receiving unit 1000. FIG. 11C depicts a timing chart showing change of the Enable signals EN1, EN2 that control the regulator 1540.

Figures 11A, 11B, 11C:
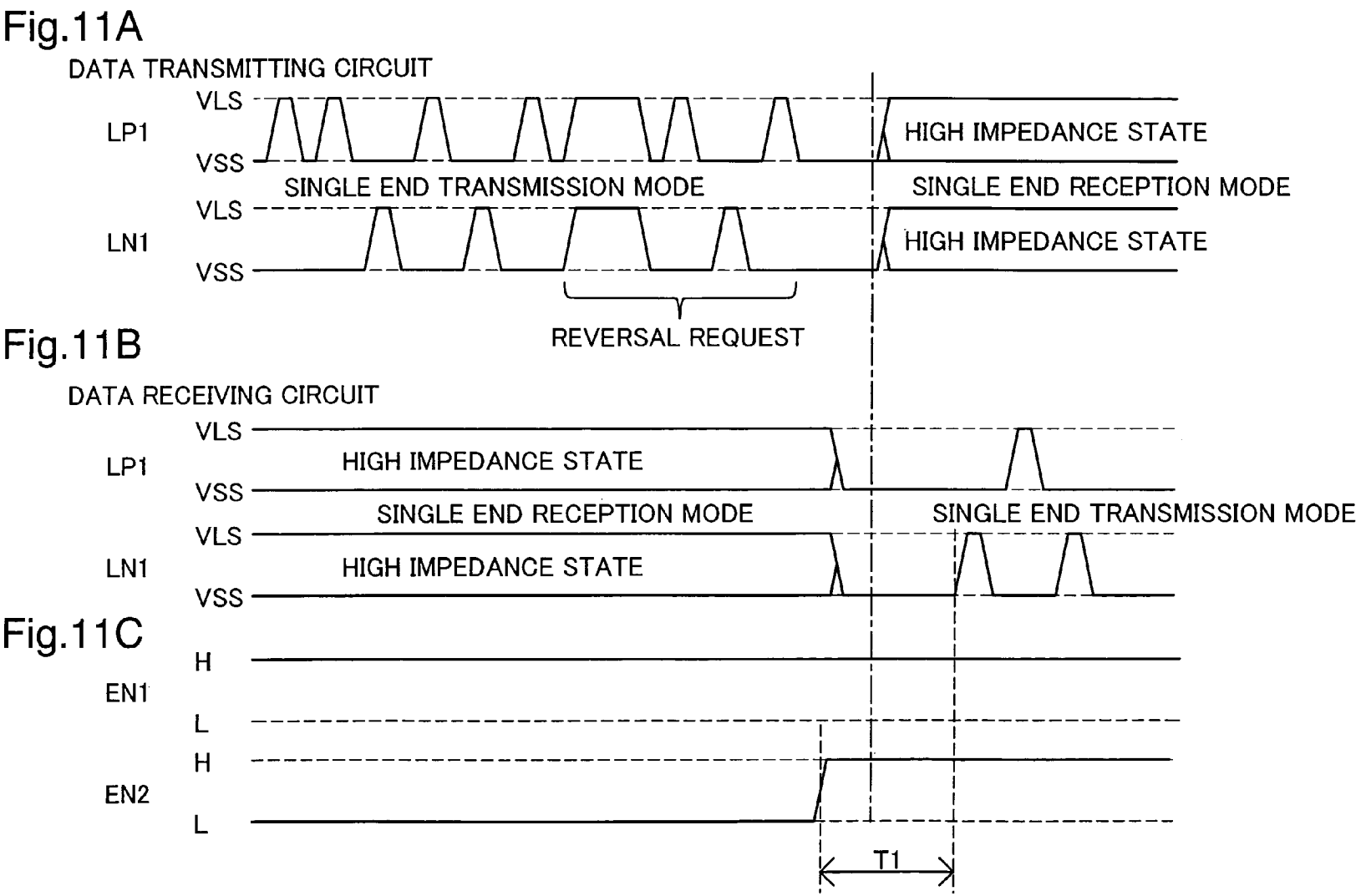
FIG. 11A depicts a timing chart showing the signal output over the signal line LP1 by the single end driver 2531, and a timing chart showing the signal output over the signal line LN1 by the single end driver 2532, in the data transmitting circuit 2500*a* of the master transmitting/receiving unit 2000.
FIG. 11B depicts a timing chart showing the signal output over the signal line LP1 by the single end driver 1533, and a timing chart showing the signal output over the signal line LN1 by the single end driver 2532, in the data receiving circuit 1500*a* of the slave transmitting/receiving unit 1000.
FIG. 11C depicts a timing chart showing change of the Enable signals EN1, EN2 that control the regulator 1540.
Figure 12:
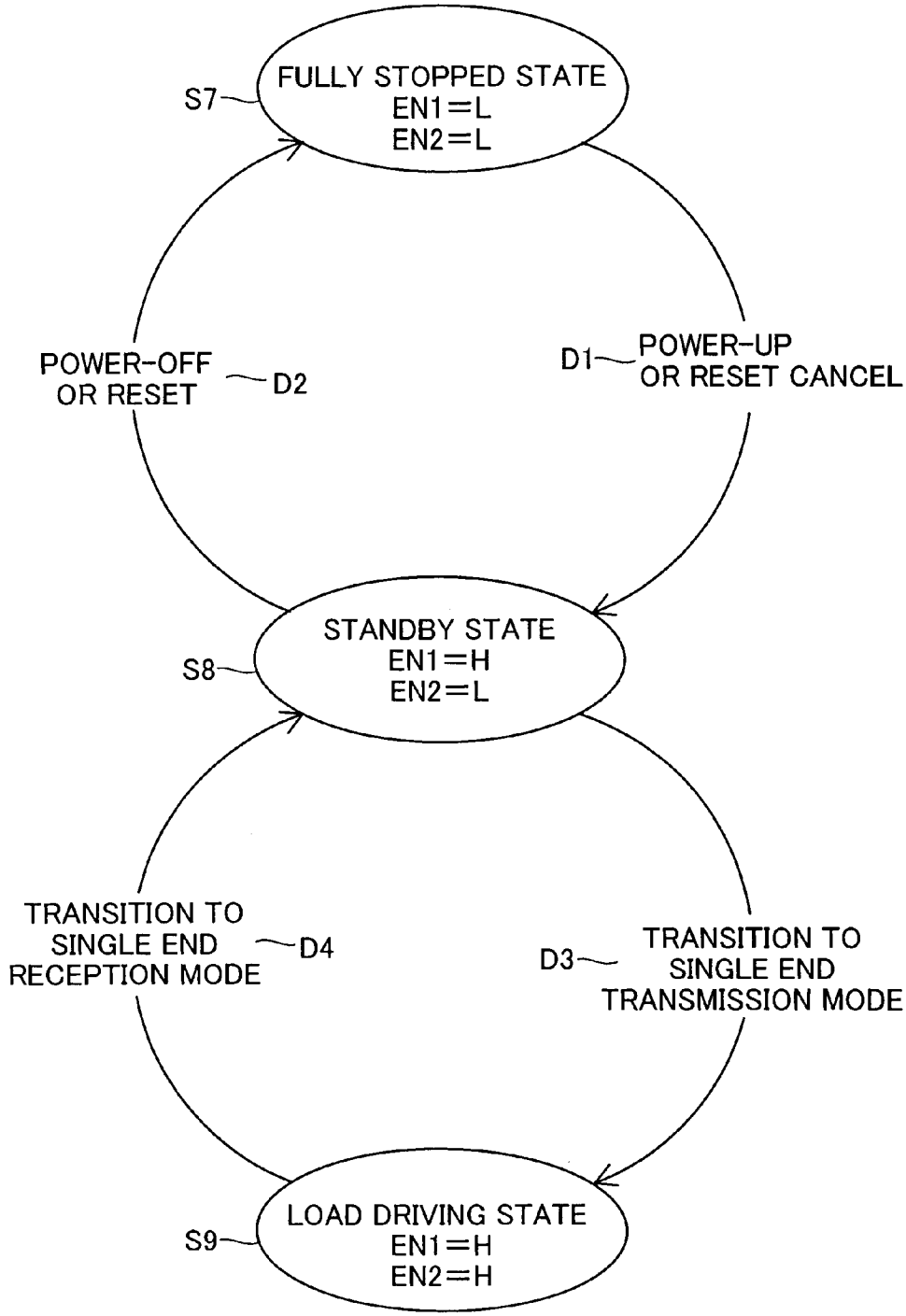
FIG. 12 shows summary of state transitions of the regulator 1540.

As shown in FIGS. 11A-C, when the data transmitting circuit 2500*a* is in the single end transmission mode S2, the data receiving circuit 1500*a* will be in the single end reception mode S5. At this time, the single end drivers 2531, 2532 of the data transmitting circuit 2500*a* will be connected respectively to the signal line LP1 and the signal line LN1, and output signal end signals LS. On the other hand, the single end drivers 1533, 1534 of the data receiving circuit 1500*a* will have stopped operation, and will be electrically cut off from the signal line LP1 and the signal line LN1 (i.e. a state of high impedance) respectively. At this time, as shown in FIG. 11, the regulator 1540 will be placed in the standby state (EN1=High, EN2=Low) discussed earlier. As mentioned earlier, in the standby state, the regulator 1540 is driven by relatively low current on the order of several μA to 10 μA, and thus the bypass capacitor C1 (FIG. 8) will be slowly charged by trickle current.

As shown in FIG. 11A, in this state, once the single end drivers 2531, 2532 of the data transmitting circuit 2500*a* transmit a reversal request CM2, the data transmitting circuit 2500*a* will transition from the single end transmission mode S2 to the single end reception mode S3 (see FIG. 4, FIG. 11A); and the data receiving circuit 1500*a* will transition from the single end reception mode S5 to the single end transmission mode S6 (see FIG. 10, FIG. 11B). At this time, the single end drivers 2531, 2532 of the data transmitting circuit 2500*a* will be electrically cut off from the signal line LP1 and the signal line LN1 (i.e. a state of high impedance) respectively. On the other hand, the single end drivers 1533, 1534 of the data receiving circuit 1500*a* will be connected respectively to signal line LP1 and the signal line LN1, and will be enabled to output single end signals LS. Furthermore, at this time the Enable signal EN2 will switch to High and the regulator 1540 will be placed in the load driving state (EN1=High, EN2=High) discussed earlier. Subsequently, the single end drivers 1533, 1534 of the data receiving circuit 1500*a* will output the initial single end signal LS as a response to the reversal request.

Here, in order to achieve stabile operation of the single end drivers 1533, 1534 it will be necessary for the regulator 1540 to be stabilized in the load driving state, coincident with the timing of transmission of the initial single end signal LS. In some instances, it will be necessary for the time interval T1 between the time that the data receiving circuit 1500*a* receives the reversal request CM2 and the time that the initial single end signal LS is sent to be a relatively short interval (e.g. ≦350 ns), as stipulated inter alia by the standard for the transfer format.

In the present embodiment, prior to receiving the reversal request CM2 the regulator 1540 will have been placed in the standby state and the bypass capacitor C1 will be charging, and therefore rapid stabilization in the load driving state will be possible subsequent to transition to the load driving state.

State transitions of the regulator 1540 are summarized in FIG. 12. During power-up or a reset cancel of the digital device (FIG. 12: D1) the regulator 1540 will transition from the fully stopped state S7 to the standby state S8; and during power-down or a reset (FIG. 12: D2), it will transition from the standby state S8 to the fully stopped state S7. Also, during power up or a reset cancel, the data receiving circuit 1500*a* will assume the single end reception mode S5.

Then, when the data receiving circuit 1500*a* has transitioned from the single end reception mode S5 to the single end transmission mode S6 as discussed above (FIG. 12: D3), the regulator 1540 will transition from the standby state S8 to the load driving state S9; and when the data receiving circuit has transitioned from the single end transmission mode S6 to the single end reception mode S5 (FIG. 12: D4), the regulator will transition from the load driving state S9 to the standby state S8.

The clock receiving circuit 1500*b* performs reception of differential signals HS and transmitting/receiving of single end signals LS via the terminals DP2 and DN2. The internal configuration of the clock receiving circuit 1500*b* is basically similar to the configuration of the data receiving circuit 1500*a* described in FIGS. 7 to 9, and will not be discussed in detail. The operation of the clock receiving circuit 1500*b* is basically similar to the operation of the data receiving circuit 1500*a* described in FIGS. 10 to 12, and will not be discussed in detail.

As will be apparent from the preceding description, the single end drivers 1533, 1534 in the embodiment correspond to the element of the transmitting circuit recited in the claims. The reversal request CM2 in the embodiment corresponds to the element of the reply request signal recited in the claims.

According to the embodiment discussed hereinabove, the regulator 1540 will be placed in the load driving state S9 with high power consumption only during the single end transmission mode S6 in which the single end drivers 1533, 1534 are operational; and will be placed in the standby state S8 with low power consumption during the differential reception mode S4 and the single end reception mode S5. As a result, total power consumption by the regulator 1540 can be minimized, for example.

In the present embodiment, the slave transmitting/receiving unit 1000 has the principal function of receiving data HD, LD for sending to the LCD driver 600, and of receiving the high-speed transfer clock HC constituting the sync signal for high-speed transfer; thus, the data receiving circuit 1500*a* and the clock receiving circuit 1500*b* of the slave transmitting/receiving unit 1000 will operate in differential reception mode S4 or single end reception mode S5 substantially most of the time, and intervals of operation in the single end transmission mode S6 will be very short. Accordingly, if the regulator 1540 is normally placed in the load driving state S9, there will be appreciable waste of power.

Meanwhile, if during operation in a mode other than the single end transmission mode S6 the regulator 1540 were placed in the fully stopped state S7, and the regulator 1540 placed in the load driving state S9 only when operating in the single end transmission mode S6, some time would be required to charge the bypass capacitor C1 before the regulator 1540 stabilizes in the load driving state S9 when transitioning from the fully stopped state S7 to the load driving state S9. With such an arrangement, there is a risk that the regulator 1540 will not be able to stabilize in the load driving state S9 before transmission of the initial single end signal LS mentioned previously. If it is attempted to shorten the time required for stabilization during transition from the fully stopped state S7 to the load driving state S9, it will be necessary for the bypass capacitor C1 to be charged rapidly by supplying it with high current. Such high current poses the risk of associated noise, as well as the risk of adverse effects on the data receiving circuit 1500*a* and on surrounding circuits. As described above, in the present embodiment, during operation in a mode other than the single end transmission mode S6, the regulator 1540 will placed in the standby state S8 and the bypass capacitor C1 will be charged using trickle current. As a result, for example, noise can be suppressed and the regulator 1540 can be rapidly stabilized in the load driving state S9 when transitioning from the standby state S8 to the load driving state S9. Once stabilized in the load driving state S9, the regulator 1540 will be driven by relatively large current and thus the bypass capacitor C1 will be charged using larger current than in the standby state S8, when current has been consumed by operation of the load, i.e. the single end drivers 1533, 1534. Accordingly, during operation in the load driving state S9, for example, the regulator 1540 can respond rapidly to operation of the single end drivers 1533, 1534, and can output stabilized voltage Vout. For example, stabilized operation of the single end drivers 1533, 1534 in the single end transmission mode S5 can be assured thereby.

B. Modified Embodiments

Modified Embodiment 1

Figure 13:
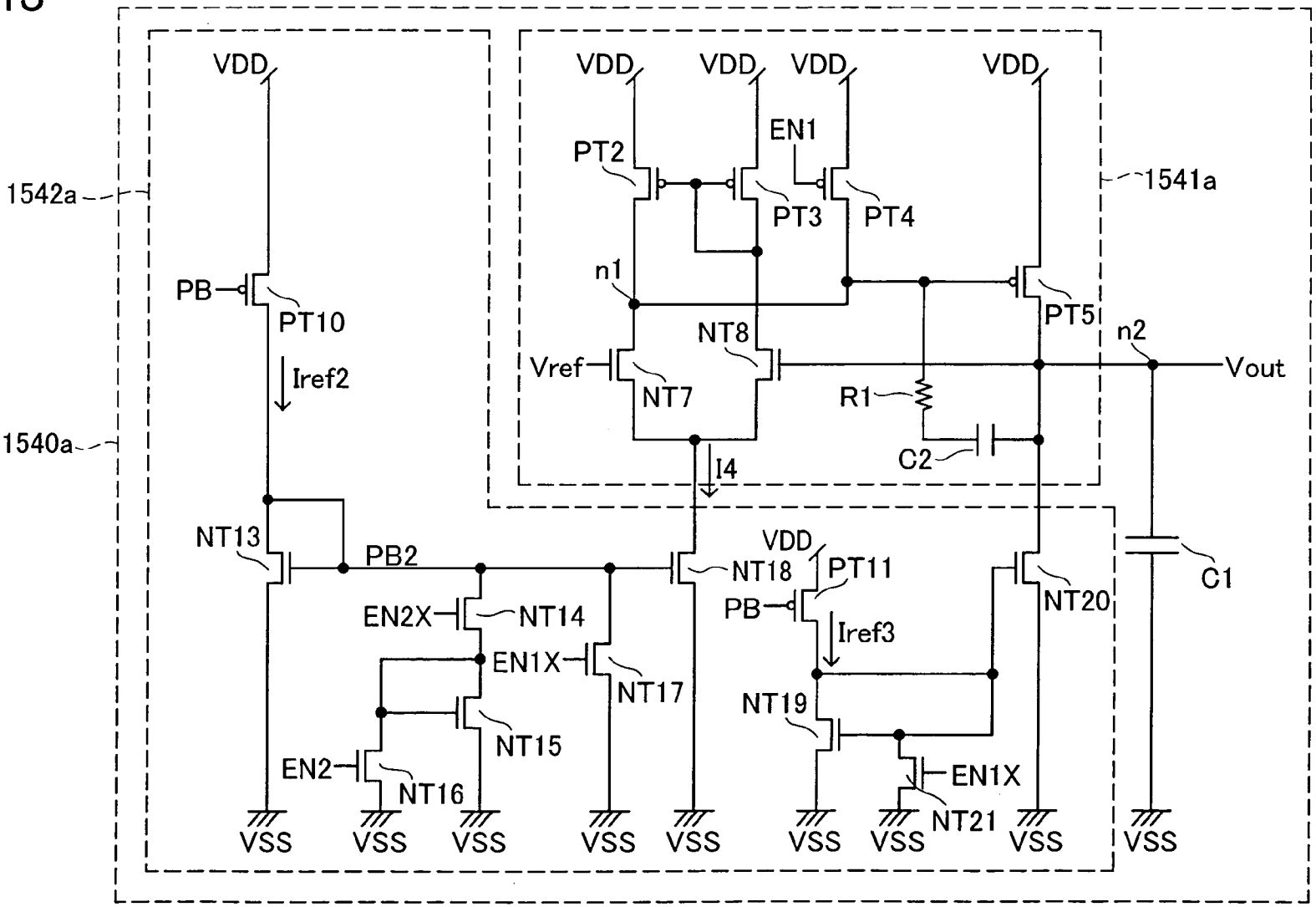
FIG. 13 is a circuit diagram depicting the internal configuration of the regulator in this modified embodiment.

The configuration depicted in FIG. 8 is merely exemplary and is in no way limiting. Another configuration for the regulator pertaining to Modified Embodiment 1 will be described with reference to FIG. 13. FIG. 13 is a circuit diagram depicting the internal configuration of the regulator in this modified embodiment.

As shown in FIG. 13, the regulator 1540*a* in Modified Embodiment 1 is furnished with an output controller 1541*a* and an electric current source 1542*a*. The configuration of the output controller 1541*a* is identical to that of the output controller 1541 of the regulator 1540 in the preceding embodiment (FIG. 8) and will therefore be assigned the same symbols as in the output controller 1541, without further discussion.

The electric current source 1542*a* is furnished with a p transistor PT10 which generates a constant current Iref2; and a p transistor PT11 which generates a constant current Iref3. The current control voltage PB from the bias circuit 1550 is input to each gate of p transistors PT10 and PT11.

The drain of a diode-connected n transistor NT13 is connected to the drain of the p transistor PT10. Also connected to drain of the p transistor PT10 is the drain of a diode-connected n transistor NT15, connected thereto via an n transistor NT14 which functions as an Enable switch controlled by the inverted signal EN2X of the Enable signal EN2. Specifically, when the Enable signal EN2 is Low (EN2X is High), the drain of the diode-connected n transistor NT13 and the drain of the diode-connected n transistor NT15 are parallel-connected to the drain of the p transistor PT10; and when the Enable signal EN2 is High (EN2X is Low), the drain of the diode-connected n transistor NT13 is connected to, and the n transistor NT15 is cut off from, the drain of the p transistor PT10.

The electric current source 1542*a* is also furnished with an n transistor NT18 whose gate is input the current control voltage PB, and which functions as the constant current source of the differential amplifier circuit.

In the electric current source 1542*a*, the n transistors NT16, NT17 are Enable switches. The n transistor NT17 is controlled by the inverted signal EN1X of the Enable signal EN1; the transistor NT16 is controlled by the Enable signal EN2.

Here, when the regulator 1540 is in the fully stopped state (EN1=Low, EN2=Low), the n transistor NT17 constituting the Enable switch will go On, and function of the n transistor NT18 as the constant current source will be disabled. Consequently, the drive current I4 of the differential amplifier circuit will be zero.

When the regulator 1540 is in the standby state (EN1=High, EN2=Low), the n transistor NT17 constituting the Enable switch will go Off, and function of the n transistor NT18 as the constant current source will be enabled. The drain of the diode-connected n transistor NT13 and the drain of the diode-connected n transistor NT15 will then be parallel-connected to the drain of the p transistor PT10 as described above. As a result, there will be determined a current control voltage PB2 (gate voltage of the n transistor NT13 and the n transistor NT15) such that the sum of the drain current of the n transistor NT13 and the drain current of the n transistor NT15 will be equal to the drain current Iref2 of the p transistor PT10. The drive current I4 of the differential amplifier circuit will then be determined to a constant value, depending on the current control voltage PB2.

If on the other hand, the regulator 1540 is in the load driving state (EN1=High, EN2=High), the n transistor NT17 constituting the Enable switch will go Off, and function of the n transistor NT18 as the constant current source will be enabled. The drain of the diode-connected n transistor NT13 will be connected to, and the drain of the diode-connected n transistor NT15 will be cut off from, the drain of the p transistor PT10 in the manner discussed earlier. As a result, there will be determined a current control voltage PB2 (gate voltage of the n transistor NT13) such that the drain current of the n transistor NT13 will be equal to the drain current Iref2 of the p transistor PT10. The drive current I4 of the differential amplifier circuit will then be determined to a constant value, depending on the current control voltage PB2.

Here, the current control voltage PB2 will be determined by the level of drain current of the n transistor NT13. In the standby state, the drain current of the n transistor NT13 will be lower than in the load driving state, by the equivalent of that part of the drain current Iref2 of the p transistor PT10 that becomes drain current of the n transistor NT15. As a result, the current control voltage PB2 will be lower in the standby state than in the load driving state. As a result, the drive current I4 of the differential amplifier circuit will be lower in the standby state than in the load driving state. The drive current I4 of the differential amplifier circuit in the standby state will be determined by the characteristics of the n transistor NT13 and of the n transistor NT18; while the drive current I4 of the differential amplifier circuit in the load driving state will be determined by the characteristics of the n transistor NT13, the n transistor NT15, and the n transistor NT18.

To the drain of the p transistor PT11 that produces the constant current Iref3 is connected a diode-connected transistor NT19 so as to output from its gate a current control voltage PB3 dependent on the constant current Iref3. The electric current source 1542*a* is also furnished with an n transistor NT20 to whose gate is input the current control voltage PB3, thereby functioning as a constant current source. The n transistor NT20 functions as the constant current source of the p transistor PT5 of the output controller 1541. In the electric current source 1542*a*, *n* transistor NT21 is an Enable switch controlled by the inverted signal EN1X of the Enable signal EN1; when the Enable signal EN1=High (ENX1=Low), function of the n transistor NT20 as the constant current source is enabled; and when the Enable signal EN1=Low (ENX1=High), function of the n transistor NT20 as the constant current source is disabled.

Like the internal current of the regulator 1540 in the Embodiment, the internal current of the regulator 1540*a* in the modified embodiment discussed above is set in the standby state to about several μA to 10 μA, and in the load driving state to about several hundred μA, for example.

Advantages and working effects analogous to those of the Embodiment may be achieved through the use of the regulator 1540*a* regulator 1540*a* in the modified embodiment discussed above, for example.

Modified Embodiment 2

Whereas in the preceding Embodiment, the regulator 1540 is placed in the standby state when the data receiving circuit 1500*a* is in a mode besides the single end transmission mode S6; however, it would be acceptable instead to place it in the standby state during the single end reception mode S5, and in the fully stopped state during the differential reception mode S4. Typically, the regulator may be placed in the standby state for at least a prescribed time interval prior to transition to the single end transmission mode S6 in which the single end drivers 1533, 1534, which are the circuits that supply the driving voltage by means of the regulator 1540, are operational. The prescribed time interval will be the interval required to slowly charge the bypass capacitor C1, with the regulator 1540 in the standby state.

Other Modified Embodiments

In the preceding embodiment, the transmitting and receiving system composed of the slave transmitting/receiving unit 1000 and the master transmitting/receiving unit 2000 is employed as an interface between the image processing unit 500 and the LCD driver 600, but is not limited thereto. The transmitting and receiving system could instead by employed as an interface for communications of various kinds, for example, for communication between chips, communication between boards, or communication between various types of device modules, or for internal communication in a backplane adapted for installation of circuit boards.

The digital device in the preceding embodiment include liquid crystal display 700, and the transmitting and receiving system composed of the slave transmitting/receiving unit 1000 and the master transmitting/receiving unit 2000 is used to transmit signals for driving liquid crystal display 700. Instead of liquid crystal display 700, other display such as organic light emitting display or plasma display may be employed in the digital device. Instead of liquid crystal display 700, other electro optical device such as driving head for laser printer may also be employed in the digital device.

While the transmitting and receiving system in the preceding embodiment is furnished with a single pair of signal lines for data transmission (LP1, LN1) and a single pair of signal lines for clock transmission (LP2, LN2), it is not limited thereto. For example, it would be possible to instead provide a plurality of signal line pairs for data transmission, and a single pair of signal lines for clock transmission. Regardless of the particular configuration, each pair of signal lines will be provided on the slave transmitting/receiving unit end with an arrangement corresponding to the data receiving circuit 1500*a* in the preceding embodiment, and on the master transmitting/receiving unit end with an arrangement corresponding to the data transmitting circuit 2500*a* in the preceding embodiment.

Part of the functions actualized by the hardware structure in the above embodiment may be attained by the software configuration. On the contrary, part of the functions attained by the software configuration in the above embodiment may be actualized by the hardware structure.

While the present invention have been shown and described on the basis of the embodiment and variations, the embodiment and variations described herein are merely intended to facilitate understanding of the invention, and implies no limitation thereof. Various modifications and improvements of the invention are possible without departing from the spirit and scope thereof as recited in the appended claims, and these will naturally be included as equivalents in the invention.

What is claimed is:

1. A unit operable in a plurality of operating modes, the unit comprising:

a first circuit adapted to operate in a first operating mode, and not to operate in a second operating mode preceding the first operating mode;

a regulator adapted to supply driving voltage to the first circuit, and switchable among a plurality of levels of internal current; and current controller adapted to control the internal current of the regulator in the first operating mode to a first level among the plurality of levels of internal current, and control the internal current of the regulator in the second operating mode to a second level among the plurality of levels of internal current, the second level being lower than the first level.

2. The unit according to claim 1, wherein the unit includes a transmitting/receiving unit including a receiving circuit adapted to receive a signal from another unit and a transmitting circuit adapted to transmitting a signal to another unit, wherein the first circuit includes the transmitting circuit, wherein the first operating mode includes a mode for transmitting a signal using the transmitting circuit, and wherein the second operating mode includes a mode for receiving a signal using the receiving circuit.

3. The unit according to claim 2, wherein when the receiving circuit has received a reply request signal in the second operating mode, the unit transits from the second operating mode to the first operating mode and the current controller switches the internal current of the regulator from the second level to the first level.

4. A device comprising:

the unit of claim 2; and a display driver adapted to drive a display device using the signal received by the unit.

5. A device comprising:

the unit of claim 2; and a driver adapted to drive a electro optical device using the signal received by the unit.

6. A transmitting/receiving system including a first transmitting/receiving unit and a second transmitting/receiving unit interconnected via signal lines, wherein at least one of the first transmitting/receiving unit and the second transmitting/receiving unit includes the unit of claim 2.

7. A control method related to a first circuit adapted to operate in a first operating mode, and not to operate in a second operating mode preceding the first operating mode, the control method comprising:

controlling an internal current of a regulator to a first level in the first operating mode, the regulator being adopted to supply driving voltage to the first circuit; and controlling the internal current of the regulator to a second level lower than the first level in the second operating mode.

8. A device comprising:

the unit of claim 3; and a display driver adapted to drive a display device using the signal received by the unit.

9. A device comprising:

the unit of claim 3; and a driver adapted to drive a electro optical device using the signal received by the unit.

10. A transmitting/receiving system including a first transmitting/receiving unit and a second transmitting/receiving unit interconnected via signal lines, wherein at least one of the first transmitting/receiving unit and the second transmitting/receiving unit includes the unit of claim 3.

* * * * *